US006729524B1

(12) United States Patent
Yao

(10) Patent No.: US 6,729,524 B1
(45) Date of Patent: May 4, 2004

(54) NAIL CARTRIDGE FOR A NAIL GUN

(75) Inventor: Jerry Yao, Taichung (TW)

(73) Assignee: Bentley Fastening Tools Co., Ltd., Taichung (TW)

( * ) Notice: Subject to any disclaimer, the term of this patent is extended or adjusted under 35 U.S.C. 154(b) by 0 days.

(21) Appl. No.: 10/329,568

(22) Filed: Dec. 27, 2002

(51) Int. Cl.[7] ..... B27F 7/00
(52) U.S. Cl. ..... 227/120; 227/109; 227/136
(58) Field of Search ..... 227/120, 109, 227/136, 135

(56) References Cited

U.S. PATENT DOCUMENTS 5,433,367 A * 7/1995 Liu ..... 227/120
5,615,819 A * 4/1997 Hou et al. ..... 227/109
5,632,431 A * 5/1997 Lin ..... 227/109
5,653,371 A * 8/1997 Hou ..... 227/109
5,704,532 A * 1/1998 Wey ..... 227/109
5,873,509 A * 2/1999 Liao ..... 227/109
6,053,389 A * 4/2000 Chu et al. ..... 227/120
6,076,721 A * 6/2000 Yang ..... 227/120
6,296,167 B1 * 10/2001 Jen ..... 227/120
6,592,016 B2 * 7/2003 Hamano et al. ..... 227/119

* cited by examiner

*Primary Examiner*—John Sipos
*Assistant Examiner*—Louis Tran
(74) *Attorney, Agent, or Firm*—Troxell Law Office PLLC

(57) ABSTRACT

A nail cartridge for a nail gun includes a nail cartridge formed integral, and a nail pusher received completely in the nail cartridge so that the appearance of the whole nail cartridge look clean and neat. The nail pusher has a special structure so as to simplify its operation and handling.

6 Claims, 5 Drawing Sheets

NAIL CARTRIDGE FOR A NAIL GUN

BACKGROUND OF THE INVENTION

This invention relates to a nail cartridge for a nail gun, particularly to one with a neat appearance and simple to handle.

A conventional nail cartridge for a nail gun can be classified into two kinds, and one kind has a nail pusher provided in a nail cartridge, and the nail cartridge is provided with a hollow center space for a slide base of the nail pusher to slide axially freely therein. At the same time, a coil spring is fixed with the slide base to push the slide base to push a nail, and a cap closes on the coil spring. So comparatively many bolts and screws are needed to assemble them and much time to be used for assembling processes to cause high cost. Besides, the shape of the nail cartridge affects the appearance of the whole nail gun in a negative way.

Another kind of the nail cartridge for a nail gun has a non-stage type of nail feeding, with the nail pusher provided on the nail cartridge, and in arranging nails, the slide base has to be pushed to reach the bottom of the nail cartridge. In this process, the slide base may extend out of the nail cartridge too long, and the user has to exert hand force to resist against the resilience of the coil spring until the nails are arranged completely. Then the user can fix the slide base on the nail cartridge, inconvenient to handle and dangerous to be easily touched with.

SUMMARY OF THE INVENTION

This invention has been devised to offer a nail cartridge for a nail gun formed integral and with a nail pusher completely contained in the nail cartridge to enable the whole appearance of the nail cartridge look neat, and the nail pusher is designed to h a v e a special effect for easy handling.

BRIEF DESCRIPTION OF DRAWINGS

This invention will be better understood by referring the accompanying drawings, wherein.

DETAILED DESCRIPTION OF THE INVENTION

Figure 1:
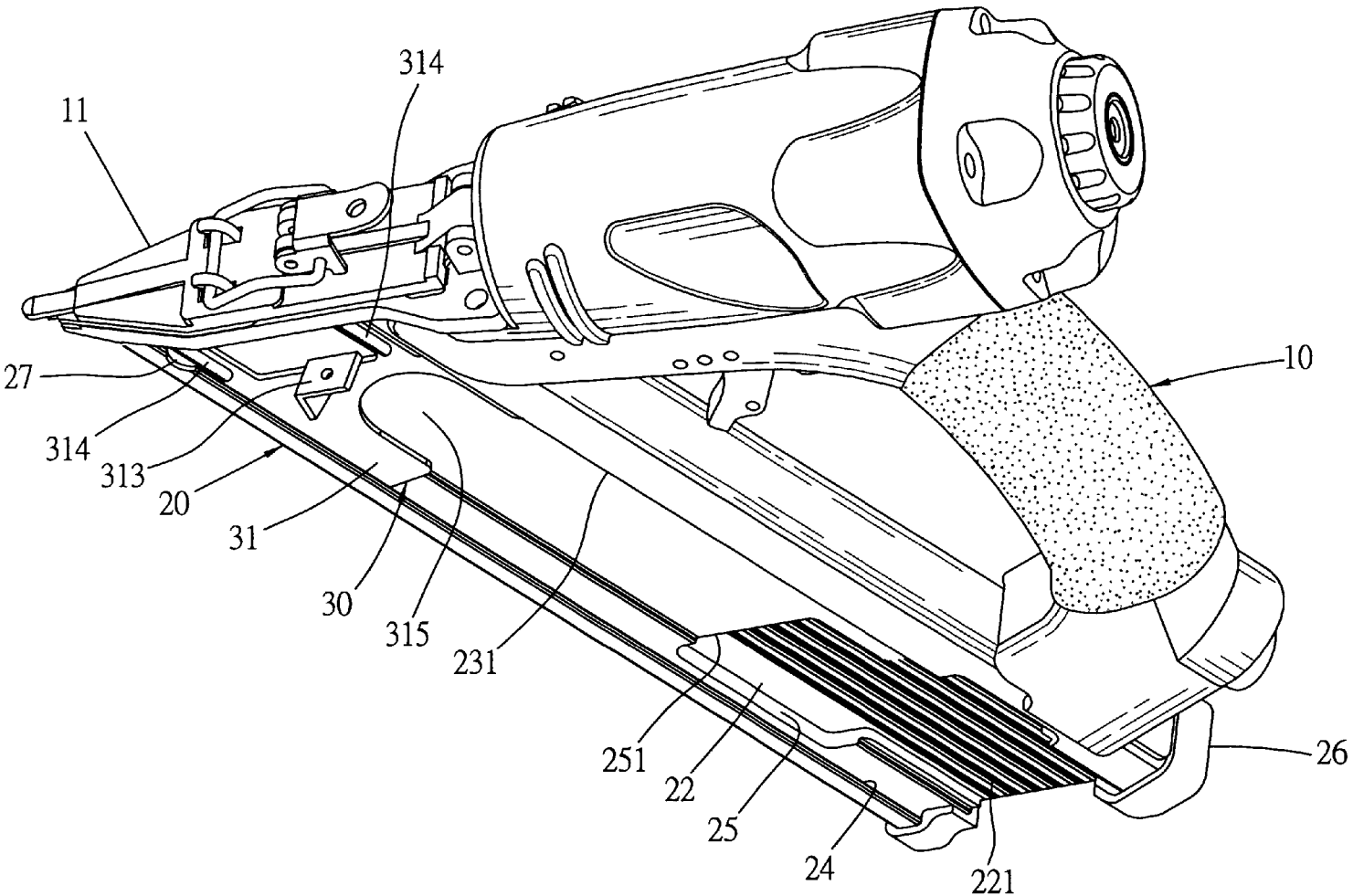
FIG. 1 is a perspective view of a nail gun using a preferred embodiment of a nail cartridge in the present invention.
Figure 2:
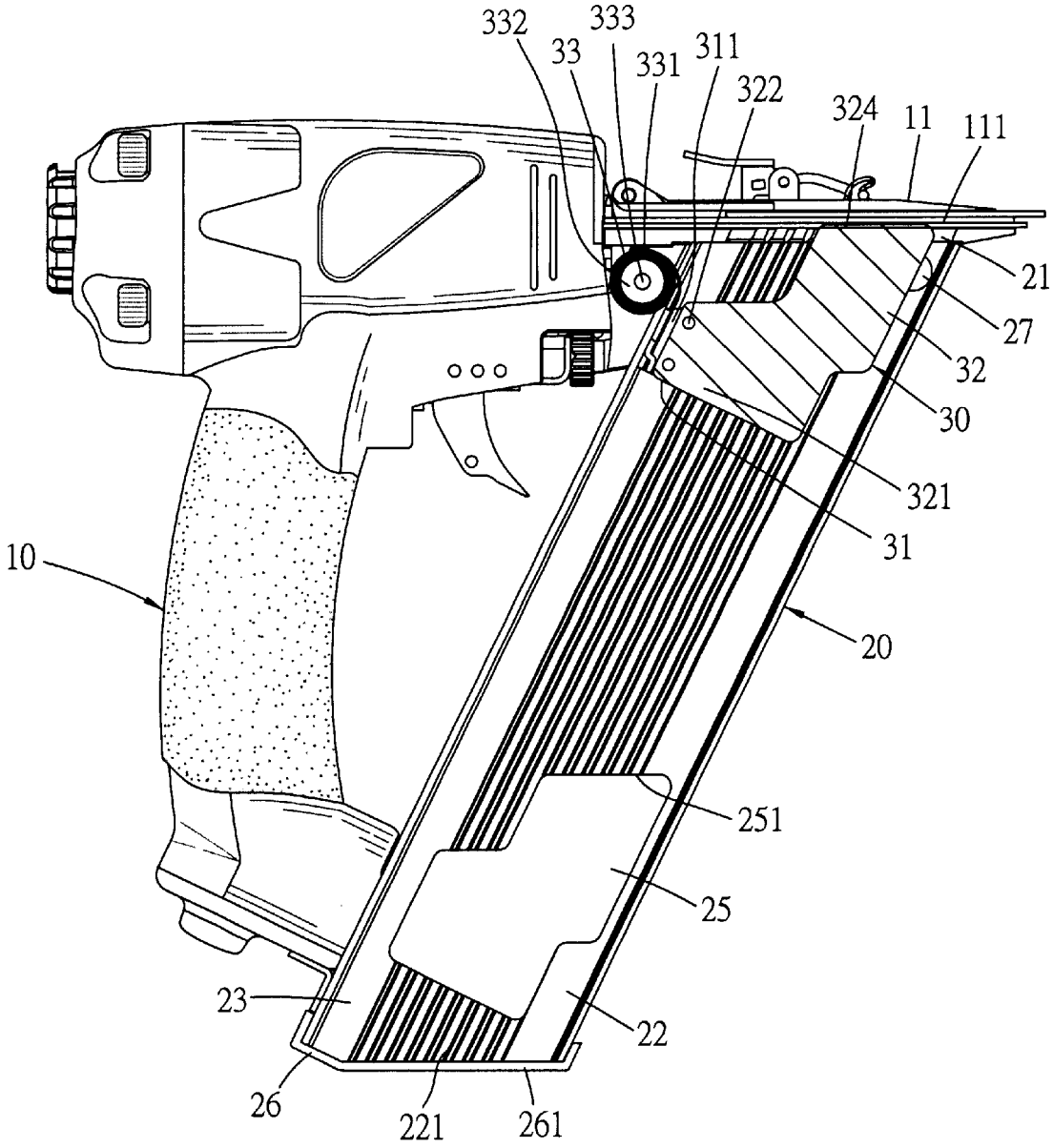
FIG. 2 is a side cross-sectional view of the nail gun using the preferred embodiment of a nail cartridge in the present invention.
Figure 3:
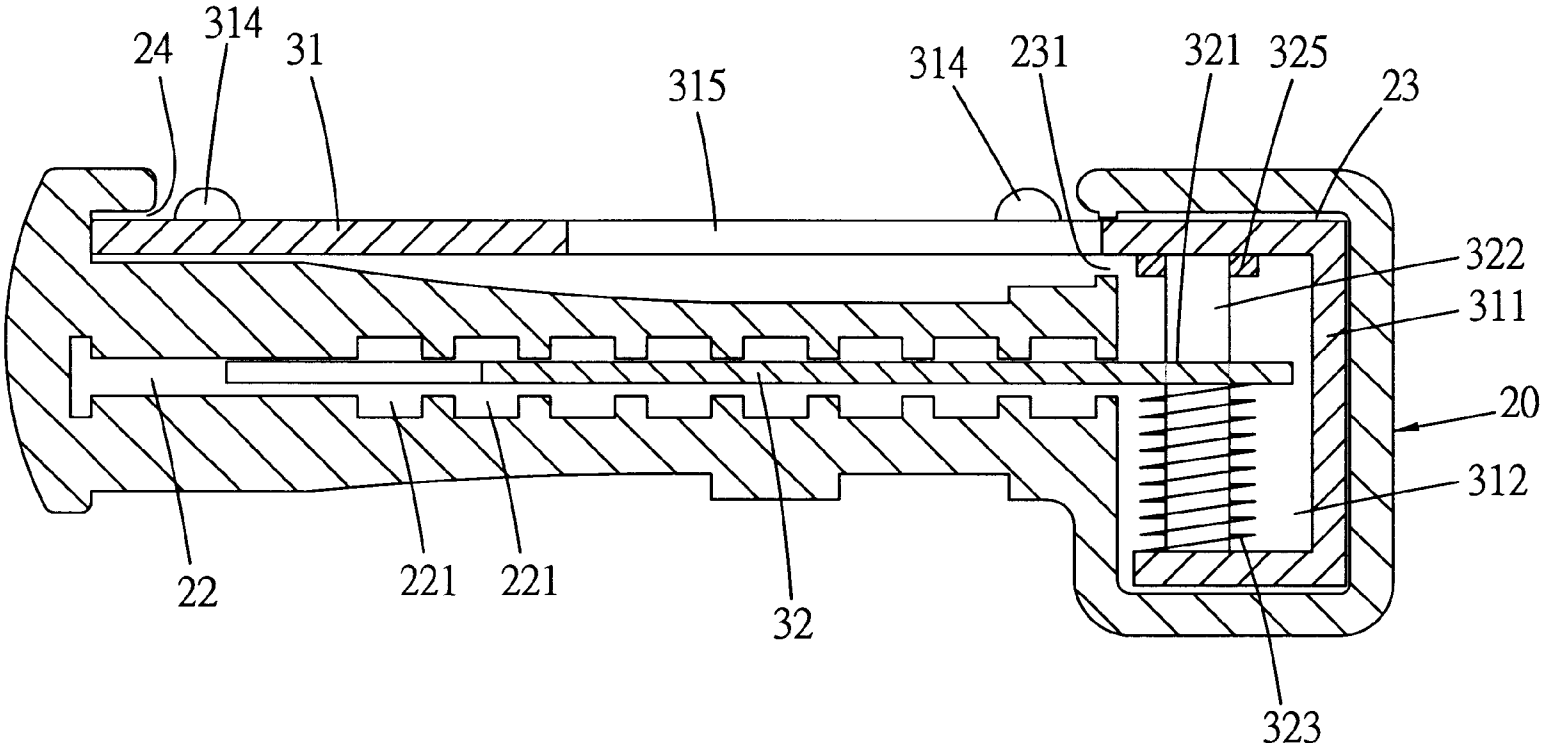
FIG. 3 is a partial cross-sectional view of the preferred embodiment of a nail cartridge in the present invention.

A preferred embodiment of a nail cartridge for a nail gun 10 in the present invention, as shown in FIGS. 1, 2 and 3, includes a nail hitting guider 11, a nail cartridge 20 fixed under the nail hitting guider 11, a passageway 21 formed between the nail cartridge 20 and the nail hitting guider 11 and communicating with the both 20 and 11, a nail pusher 30 combined in the nail cartridge 20, and a group nail 40 to be pushed orderly in a nail hitting groove 111 of the nail hitting guider 11.

The nail cartridge 20 is shaped as a long rectangle, having a nail way 22 formed integral axially in the inner side, a plurality of limit grooves 221 formed lengthwise in a lower surface defining the nail way 20 and spaced apart equidistantly for a group nail 40 of different sizes to fit therein, a rail groove 23 formed at one side of the nail way 22 and having a notch 231 at a neighboring point of the nail way 22 and the rail groove 23, a slide groove 24 formed in the nail way 22 at the other side facing the notch 231, and an opening 25 formed in a lower side and communicating with the nail way 22. Further, a stop wall 251 is formed at an upper side of the opening 25, and a bottom cap 26 is provided to close an open bottom end of the nail cartridge 20, having a nail hole 261 communicating with the nail way 22. Further, the nail cartridge 20 also has a peephole 27 formed in a location a little below the top and communicating with the nail way 22.

The nail pusher 30 is consisted of a guide plate 31, a push member 32, and a whirl spring 33.

The guide plate 31 has a guide rail 311 formed integral at one side and slidably fitted in the rail groove 23 of the nail cartridge 20, a cavity 312 formed in the slide corresponding to the nail way 22. The guide plate 31 has the other side of the guide rail 311 just fitted in the slide groove 24 of the nail cartridge 20, and it moves axially with the nail cartridge 20 along the rail groove 23 and the slide groove 24. Further, a moving member 313 is provided at the topside of the guide plate 31 for a user to handle the guide plate 31, and a stop member 314 is formed respectively at two sides of the top of the guide plate 31 to position under the nail hitting guider 11. Moreover, the guide plate 31 has an opening 315 formed in the center near the bottom.

The nail pusher 32 has a wing 321 extending to one side into the cavity 312 of the guide rail 311 and passed through vertically by two rods 322. One of the two rods 322 has a coil spring 323 fitted around it so as to push the wain 321 upward, and a partial portion of the wing 321 faces the opening 315 of the guide e pate 31. Further, the nail pusher 32 has a stop member 324 formed at top of the other side, and the stop member 324 can slide along the nail way 22 to push a group nail 40 or to push against the stop wall 251. Besides, the two rods 322 respectively have a gasket 325 fixed on their top, with the thickness of the gaskets 325 controlling the height above the nail pusher 32, The whirl spring 33 is formed with an elongate narrow plate spring 331 wound around a sleeve shaft 332, and the sleeve shaft 332 is fixed on a small shaft 333 pivotally connected to a neighboring side of the nail hitting, guider 11. The elongate narrow plate spring 331 is positioned in the rail groove 23 of the nail cartridge 20, and has its inner end hooked with the inner wall of the cavity 312 of the guide rail 211. Then when the guide plate 31 operates, it can pull the elongate narrow plate spring 331, which then recovers its resiliency to pull in the guide plate 31.

Figure 4:
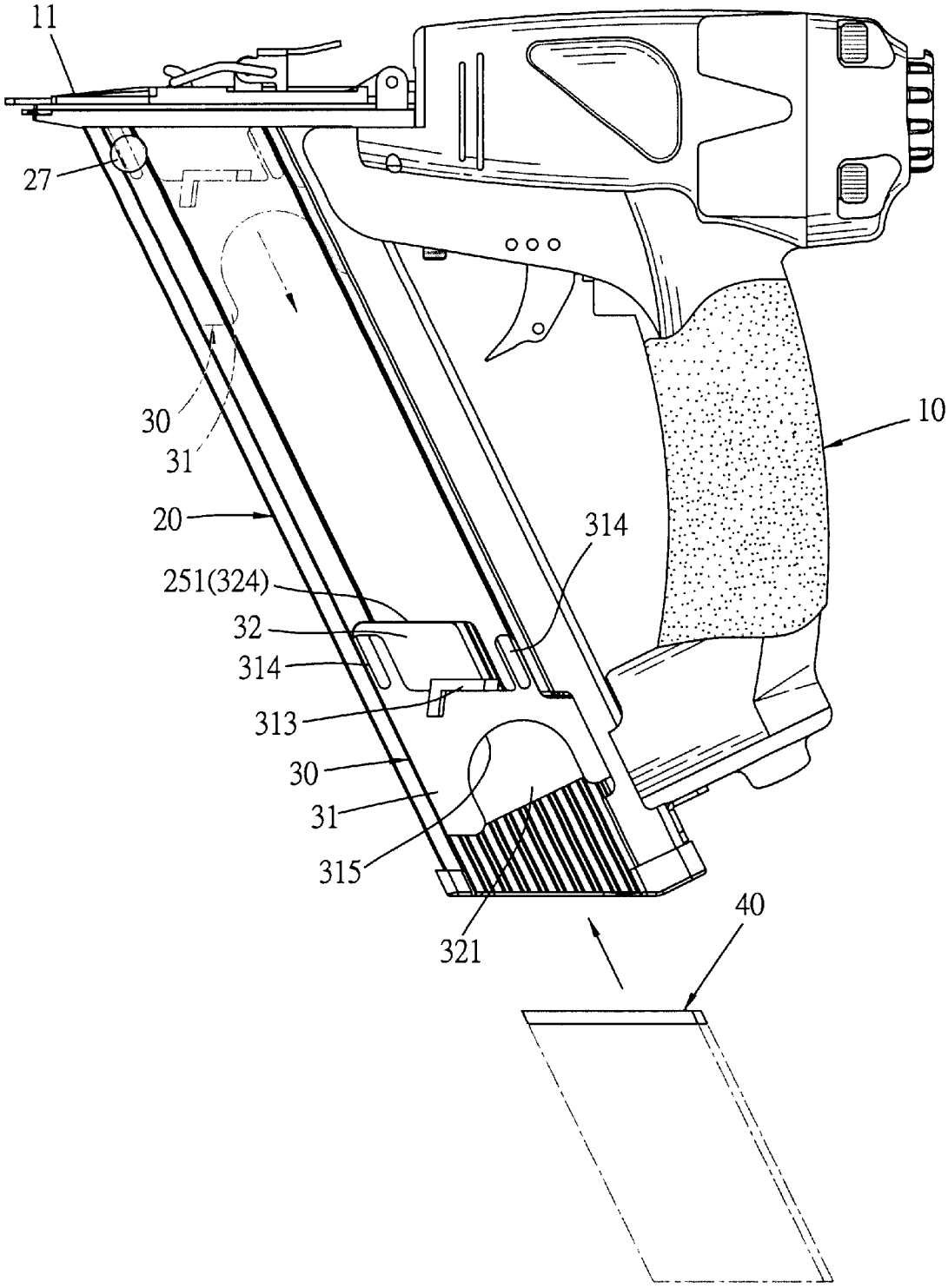
FIG. 4 is a side view of a guide plate in the preferred embodiment of a nail cartridge in the present invention, showing its movement; and, FIG. 5 is a side cross-sectional view of a nail pusher in the preferred embodiment of a nail cartridge in the present invention, showing its movement
Figure 5:
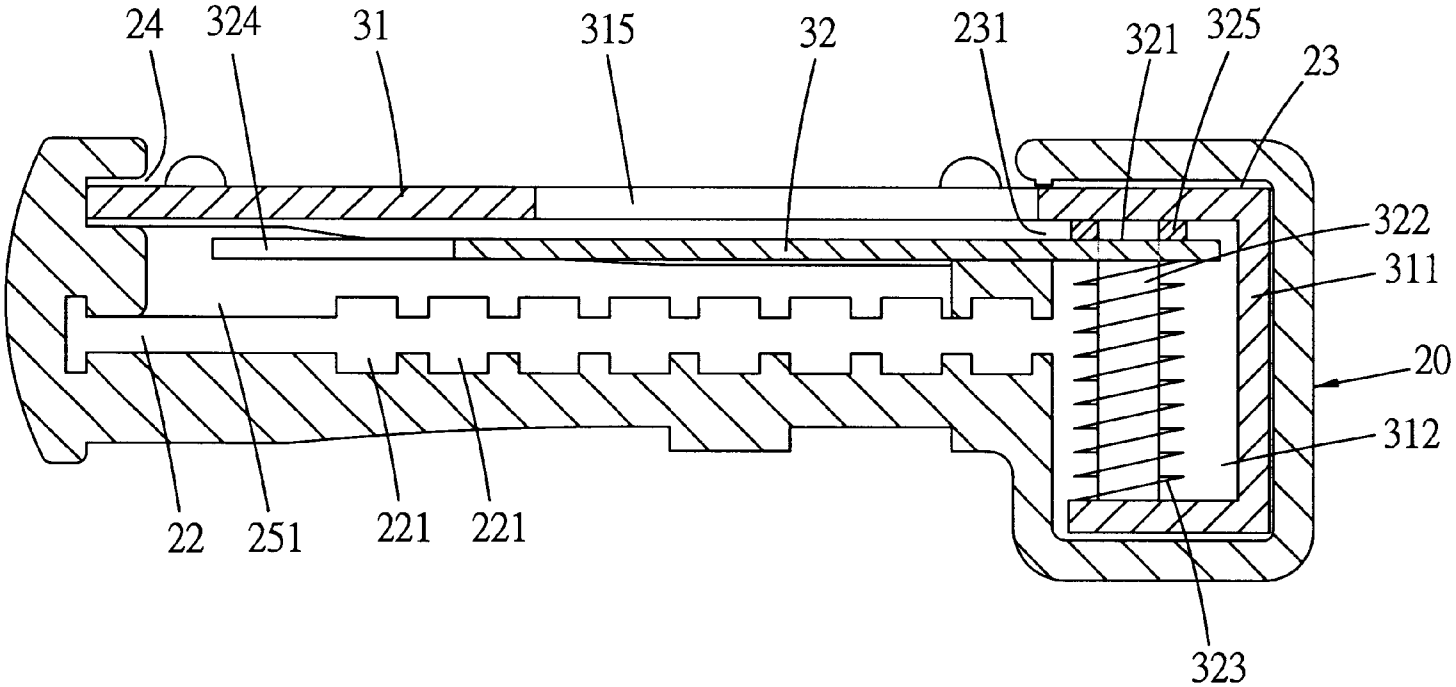

Next, referring to FIGS. 4 and 5, when the nail gun 10 is to have group nails 40 loaded in for using, first, move the moving member 313 of the guide plate 31 with a finger, forcing the guide plate 31 move down toward the nail cartridge 20. Then the nail pusher 32 also moves together with the guide plate 31 until the nail pusher 32 reaches the opening 25 of the nail cartridge 20. Then the nail pusher 32 is pushed upward by the coil spring 323 of the rod 322 into the opening 25 and on the nail way 22. At this moment, release the moving member 313, and the whirl spring 33 will recover its resiliency to automatically pull back the guide plate 31, and with the stop member 324 of the nail pusher 32 contacting the stop wall 251 of the opening 25. Then the group nail 40 can be inserted through the bottom of the nail cartridge 20 into a proper position in the nail way 22. Then a user moves the moving member 313 with a finger to force the stop member 324 of the nail pusher 32 separate from the stop wall 251, and then the user pushes down the wing 312 of the nail pusher 32 with a thumb, pressing the nail pusher 32 move down to the nail way 22 as shown in FIG. 3. Then release the moving member 313 to let the whirl spring 33 recover its resiliency to enable the nail pusher 32 push up the group nail 40 so that the group nail 40 may orderly move into the hitting groove 111 of the nail hitting guider 11.

Next, referring to FIGS. 2 and 4, the stop member 314 of the guide plate 31 also has a function of positioning, mainly stopping the nail pusher 32 unable to move further when the stop member 314 stops the bottom edge of the nail hitting guider 11 during the nail pusher 32 pushing the group nail 40. Thus, the stop member 324 of the nail pusher 32 is prevented from moving too deep in the nail-hitting groove 111, effectively preventing it from hitting a hitting needle to obtain safety in operation.

Further, the peephole 27 provided in the nail cartridge is useful for a user to check the condition of the group nail 40 moved in the nail way 22 so as to control operation of the nail gun.

In addition, it is worthy to mention that the nail cartridge is formed integral, with the push member of the nail pusher and the whirl spring completely received in the nail cartridge, making the whole appearance of the nail cartridge and the whole nail gun clean and neat, and operation of loading the group nail in the nail cartridge can be carried out swiftly and handling of the nail cartridge and the nail gun is very simple.

I claim:

1. A nail cartridge for a nail gun comprising a nail hitting guider formed in a front end of a nail gun, a nail cartridge fixed under said nail hitting guider, a passageway formed between said nail cartridge and said nail hitting guider, a nail pusher provided in said nail cartridge for pushing group nails orderly into said nail hitting guider; and characterized by said nail cartridge having a nail way formed integral axially for a group nail to move therein, a rail groove formed in one side of said nail way, a notch formed near said rail groove and said nail way, a slide groove formed to face an other side of s aid nail way, an opening formed in a bottom and communicating with said nail way, said opening having a stop wall defining its upper side;

said nail pusher consisting of a guide plate, a push member and a whirl spring, said guide plate having a guide rail formed in one side, said guide rail received in said rail groove of said nail cartridge, said guide rail having a cavity facing one side of said nail way, said guide plate having an other side received slidably in said slide groove of said nail cartridge, said guide rail having a moving member formed to protrude from its top and an opening formed in its bottom; said push member having a wing extending to one side to face said opening of said guide rail, a preset number of rods passing through said wing vertically in said opening of said guide rail, a coil spring fitting around on of said rods to push up said wing, said push member having a stop member formed in a top edge, said stop member slidable in said nail way to push said group nail or stopping against said stop wall; said whirl spring consisting of an elongate narrow plate spring wound around a sleeve shaft fitted around a small shaft pivotally connected to a location near said nail hitting guider to let said elongate narrow plate spring received in said rail groove of said nail cartridge, said elongate narrow plate spring having its inner end hooked in an inner wall of said guide rail of said guide plate, said elongate narrow plate spring pulled out when said guide plate operates, said elongate narrow plate spring recovering its resiliency to pull back said guide plate.

2. The nail cartridge for an nail gun as claimed in claim 1, wherein a peephole is provided in a location a little below a top of said nail cartridge, and said peephole communicates with said nail way.

3. The nail cartridge for a nail gun as claimed in claim 1, wherein said nail cartridge has a bottom cap to close up an open bottom, and said bottom cap has a nail hole communicating with said nail way.

4. The nail cartridge for a nail gun as claimed in claim 1, wherein said cartridge way of said nail cartridge has a plurality of limit grooves formed spaced apart equidistantly in an inner wall axially near one side of said guide groove for group nails of different size to be fitted therein.

5. The nail cartridge for a nail gun as claimed in claim 1, wherein said guide plate has a stop member extending from its top to stop against the bottom edge of said nail hitting guider.

6. The nail cartridge for a nail gun as claimed in claim 1, wherein said rods respectively have a gasket fixed on top, for controlling the height above the push member with its thickness.

* * * * *